United States Patent [19]

Shigeta et al.

[11] 4,113,064

[45] Sep. 12, 1978

[54] ELEVATOR CAR MOUNTING

[75] Inventors: Masayuki Shigeta, Katsuta; Tadashi Shibata, Ibaraki, both of Japan

[73] Assignee: Hitachi, Ltd., Japan

[21] Appl. No.: 420,050

[22] Filed: Nov. 29, 1973

[30] Foreign Application Priority Data

Dec. 1, 1972 [JP] Japan ..... 47-119844

[51] Int. Cl.[2] ..... B66B 11/02

[52] U.S. Cl. ..... 187/1 R

[58] Field of Search ..... 187/1 R, 52, 52 R, 52 LC; 248/20, 21, 22; 105/453, 454; 296/28 C

[56] References Cited

U.S. PATENT DOCUMENTS

| | | | |
|---|---|---|---|
| 497,829 | 5/1893 | Shea | 105/453 |
| 1,003,913 | 9/1911 | Kilcoyne | 187/1 R |
| 1,888,989 | 11/1932 | Kratky | 105/453 X |
| 2,246,732 | 6/1941 | Hymans | 187/1 R |
| 3,342,288 | 9/1967 | Vogel et al. | 187/1 R |
| 3,690,720 | 9/1972 | Whisler | 296/28 C |

FOREIGN PATENT DOCUMENTS

| | | | |
|---|---|---|---|
| 656,019 | 11/1964 | Belgium | 187/1 R |
| 34,131 | 2/1956 | Fed. Rep. of Germany | 187/1 R |
| 1,075,365 | 7/1967 | United Kingdom | 187/1 R |

*Primary Examiner*—Evon C. Blunk
*Assistant Examiner*—James L. Rowland
*Attorney, Agent, or Firm*—Craig & Antonelli

[57] ABSTRACT

An elevator car mounting arrangement for an elevator of the type comprising a car for carrying passengers or freight mounted in a framework hung by a wire rope and guided in its ascent and descent along guide rails fixed to a shaft. The car is arranged such that it can oscillate freely in a horizontal direction whereby the transversal vibration of the car can be prevented.

24 Claims, 14 Drawing Figures

ELEVATOR CAR MOUNTING

This invention relates to an elevator device adapted for use with an elevator capable of operating at high speeds over 200 meters per minute.

Generally, high speed elevators installed in high buildings tend to produce transversal vibration of the car due to the zigzag movement of the framework which is caused to occur by transversal vibration of the buildings due to the wind or the tilting of the car due to the deflections of the rails or the lop-sidedness caused by the load applied to the car, when the car runs at high speed.

In order to minimize such transversal vibration of the car, it has hitherto been customary to provide a plurality of anti-vibration rubber members to support the floor of the car. Since the amount of compression deflection of the anti-vibration rubber is limited as described hereinafter, it is impossible to reduce the modulus of rigidity of the rubber to a sufficiently low level. Thus it has been impossible to eliminate transversal vibration of the car completely.

An object of the present invention is to provide an elevator device which is capable of completely preventing transveral vibration which might otherwise be produced in the car. This object is accomplished according to the present invention by arranging the car such that the car is capable of moving freely in a horizontal direction relative to the framework in which the car is contained.

Another object of the invention is to provide an elevator device capable of accomplishing the aforementioned object wherein the floor portion of the car contained in the framework is swingably hung by suspending means of a suitable length from the framework, and bolster means provided with balls is mounted in a portion of the framework which supports the car. By these arrangements the car can move freely in a horizontal direction relative to the framework.

Another object of the invention is to prevent the car from colliding against the framework as the former moves in a horizontal direction.

Still another object of the invention is to prevent the car from breaking out of the framework due to the abnormal upward movement of the elevator.

A further object of the invention is to provide an elevator device which is capable of detecting the load applied to the car.

Additional and other objects and features of the invention will become apparent from the description set forth hereinafter when considered in conjunction with the accompanying drawings.

Figure 9:
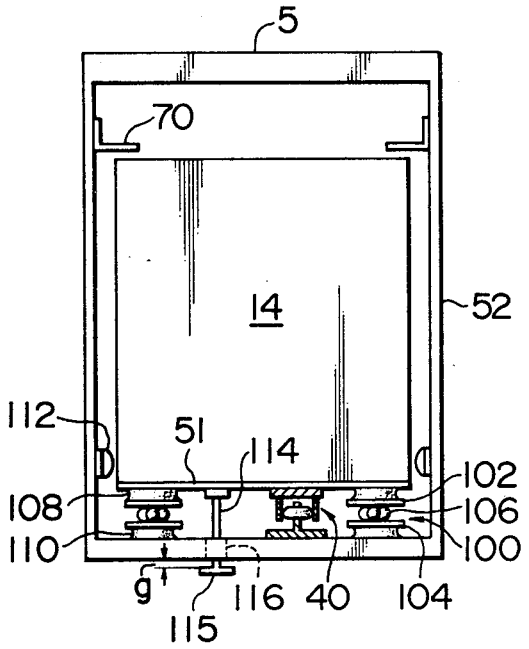
Figure 10:
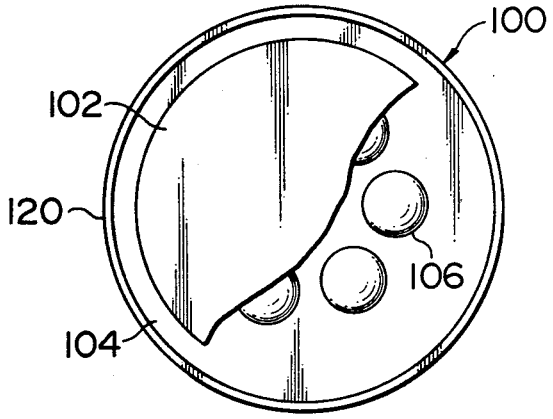
Figure 11:
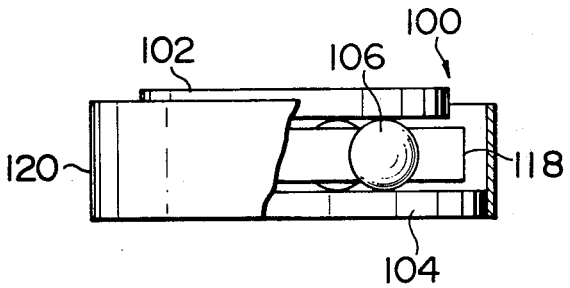
Figure 12:
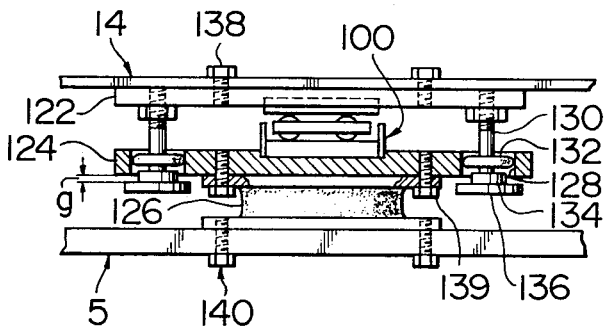
Figure 13:
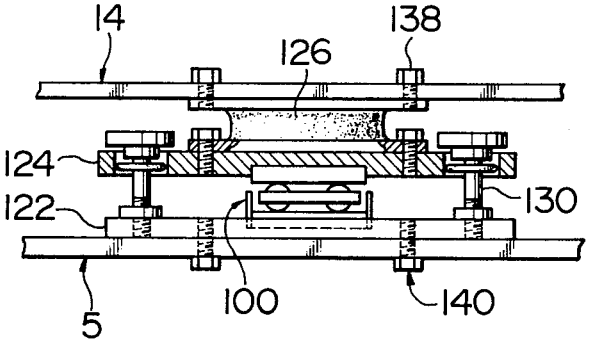
Figure 14:
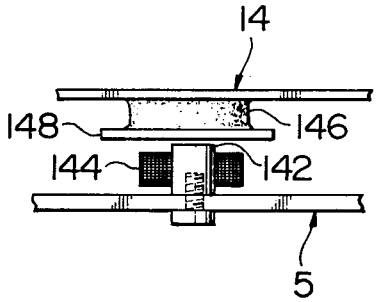

FIGS. 9 to 13 are views in explanation of other embodiments of the invention, FIG. 9 being a schematic view showing bolster means provided with balls and interposed between the framework and the car, FIG. 10 being a plan view of one form of bolster means, FIG. 11 being a partly exploded side view of the bolster means shown in FIG. 10, with certain parts being shown in section, and FIGS. 12 and 13 being schematic views showing other forms of the bolster means shown in FIG. 9; and FIG. 14 is a schematic view showing the means for preventing the horizontal movement of the car while the elevator is stationary.

The problems encountered with the prior art elevators will first be explained with reference to FIGS. 1 to 4. A wire rope 3 connected at one end to a rod 2 through a socket 1 is connected to a framework 5 through a spring 4. The framework 5 is guided by guide rails 6 and four sets of guide means 7 for vertical movement. Each guide means 7 comprises a roller 8 for guiding the left-and-right movement of the framework 5, two rollers 9 guiding the back-and-forth movement thereof, arms 10 and springs 11 for supporting the rollers 8 and a base 12 mounted on the framework 5 for firmly mounting the arms 10 and springs 11.

A car 14 is mounted in the framework 5 through a plurality of resilient members 13 made of anti-vibration rubber, so that the vibration of the framework can be isolated.

The car 14 has mounted therein a door 15 which is guided by a door-rail 16 disposed in one portion of the floor and a hook 18 having a roller 17 guided by a rail 19 mounted in the framework 5. The door is driven by a motor (not shown) mounted in the framework 5.

The following vibrational sources are presumed which tend to produce transversal vibration of the car 14 constructed as aforementioned.

(a) Transversal vibration of the wire rope 3;
(b) The presence of deflections or differences in height at the joints of the guide rails 6; and
(c) Eccentricity of the rollers 8 and 9 of the guide means 7.

In order to prevent transversal vibration of the car 14 due to the aforementioned sources, it has hitherto been customary to reduce as much as possible the elastic moduli of the plurality of resilient members 13 supporting the car 14 as well as that of the springs 11 of the guide means 7. However, a reduction in the elastic modulus of the springs 11 results in an increase in the amplitude of transversal vibration of the framework 5 due to the presence of a one-sided load in the car 14. Thus, there may arise an accident involving the collision of the framework 5 against fixtures (not shown) on the wall of the shaft essential to the operation of the elevator. Also, a reduction in the elastic modulus of the resilient members 13 causes an increase to occur in non-alignment of the floor of the car 14 with floors of the building (not shown) due to a change in the load carried by the car 14 when the elevator comes to a halt, or results in derailing of the door 15 from the door-rail 16 when the load carried by the car 14 is very great. Accordingly, the elastic moduli of the springs 11 and resilient members 13 have been set with a view to avoiding the aforementioned accident and defects. Thus, the elevator of the prior art has a natural frequency of over 2 Hz when vibrating in the transversal direction, and the device of the prior art has had little effect in preventing transversal vibration.

This invention obviates the aforementioned disadvantages of the prior art. FIGS. 3 to 8 shows one embodiment of the invention. The basic principles of the invention will be explained first with reference to FIGS. 3 and 4. The car 14 is suspended by a plurality of rods 34 connected at their ends to a lower frame 30 secured to the floor of the car 14 and at their other ends to upper frames 32 secured to the framework 5. A spring seat 38 is attached to an upper end of each rod 34, and a spring 36 is interposed between the spring seat 38 and the upper frame 32 associated with the rod. Thus, the floor portion of the car 14 suspended by the rods 34 constitutes a sort of pendulum which swings relative to the framework 5. The natural frequency Fp of this pendulum can be expressed by the following formula:

$$F_p = \frac{1}{2\pi} \sqrt{\frac{g}{L}} \ (Hz)$$

where L is the length of each rod 34 and $g$ is the gravitational acceleration. From the aforementioned formula, it will be seen that when L is 2.5 meters, Fp = 0.3 Hz, so that transversal vibration of the car can be prevented with ease.

Generally, the riding comfort of the car of an elevator is increased when the frequency of the transversal vibration is small. A high riding comfort can be obtained when the frequency of the transversal vibration of the car is about 0.7 Hz, and the riding comfort of this degree can be obtained when the rods 34 have a length of over 0.5 meter. In this embodiment, rods of high rigidity are used. It is to be understood, however, that the invention is not limited to this specific form of means of suspending the car, and that chains or ropes may be used instead with the same results. At least three rods 34 must be used for preventing lurching of the car.

Figure 5:
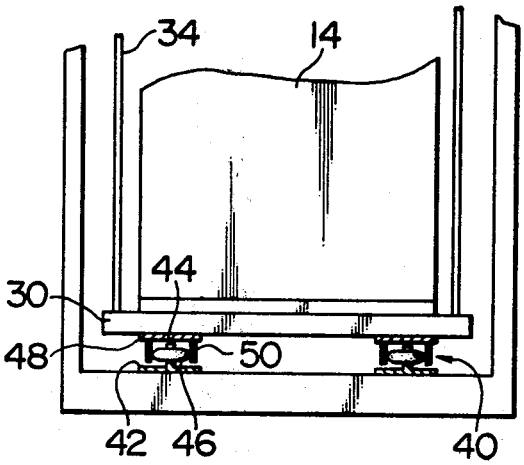
FIGS. 5 and 6 are schematic views showing the means for preventing or restricting horizontal vibration or horizontal movement of the car.

FIG. 5 shows means for keeping the car 14 from striking against the framework 5 when the former swings excessively sideways due to an external cause. Such means comprises a plurality of stabilizing stoppers 40 interposed between each lower frame 30 and the framework 5. Each stabilizing stopper 40 comprises a lower member 42 secured to the framework 5 and including an upright rod 44 having a ring-shaped rubber member 46 mounted thereon, and an upper member 48 secured to the lower frame 30 and including a cylindrical portion 50 projecting downwardly therefrom to house the rubber member 46 therein, with a clearance of a suitable amount existing between the member 46 and the inner wall surface of the cylindrical portion 50.

When the car 14 is provided with the aforementioned means for keeping the car from striking against the framework, it is possible to prevent the car 14 from colliding against the framework 5 even if the former swings excessively sideways due to an external cause, because the cylindrical portion 50 of the upper member 48 secured to the car 14 is brought into pressing engagement with the rubber member 46 of the lower member 42 secured to the framework 5, thereby preventing further transversal vibration or movement of the car 14 relative to the framework.

Figure 6:
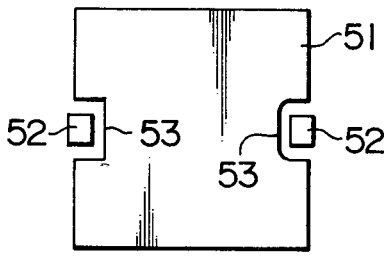

FIG. 6 shows another form of means for keeping the car from swinging sideways a large distance. Such means comprises a plurality of cutouts 53 formed in a floor 51 of the car 14 each for receiving therein one of a plurality of slings 52 which are a constituent part of the framework.

Figure 7:
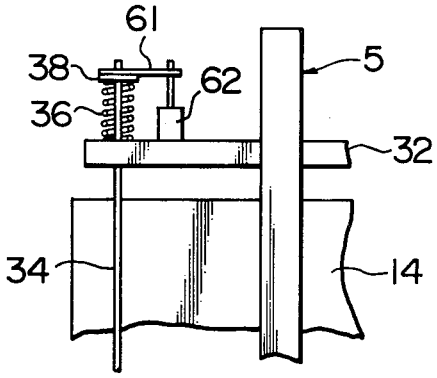
FIG. 7 is an enlarged view of the means for detecting the load carried by the car.

FIG. 7 shows means for detecting the load carried by the car 14, which is based on the fact that the rods 34 move vertically through the springs 36 as the load applied to the car 14 increases or decreases in magnitude.

More specifically, it has hitherto been customary to measure the load carried by the car 14 from the deflection of the resilient members 13 (See FIG. 1) mounted on the underside of the floor of the car 14. The degree of precision with which the load is detected is not high due to the hysteresis characteristic of rubber from which the resilient members 13 are made. Moreover, since the resilient members 13 are disposed on the underside of the floor of the car 14, difficulty has been experienced in effecting maintenance of such members.

The means shown in FIG. 7 comprises a lever 61 projecting sideways from the upper end of one of the rods 34, and a load detector 62 (such as potentiometer or differential transformer) interposed between the upper frame 32 of the framework 5 and the lever 61. This arrangement permits easy access to the load detecting means for the purpose of maintenance because such means is disposed on the top of the car 14, thereby facilitating the operator to work standing on the top of the car 14. Moreover, the use of coil springs made of metal as resilient members in place of those made of rubber improves the degree of precision with which the load is detected and the error in detecting the load can be reduced even during a sustained operation because the hysteresis characteristic of the coil spring is low.

Figure 1:
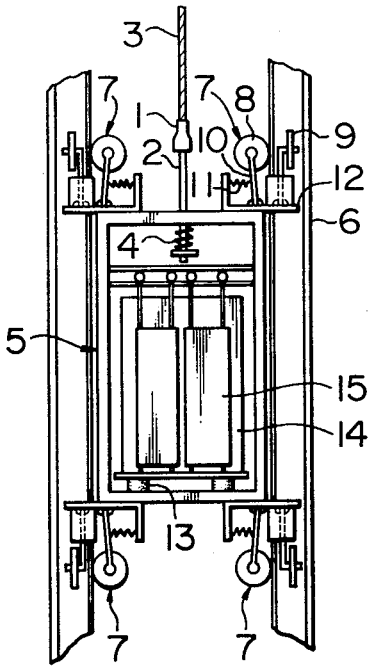
FIG. 1 PRIOR ART
FIGS. 1 and 2 are views in explanation of the problems encountered with the prior art elevators, FIG. 1 being a front view of a car of an elevator and FIG. 2 being a side view thereof.
Figure 2:
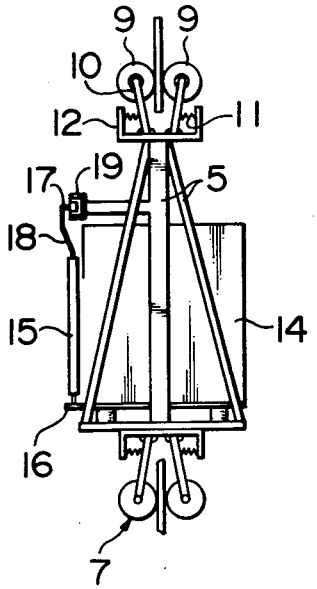
FIG. 2 PRIOR ART
Figure 3:
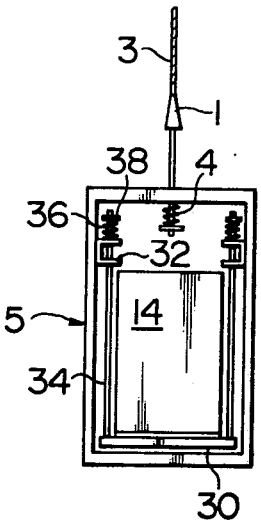
FIG. 3 is a front view of the car of the elevator showing one embodiment of the invention.
Figure 4:
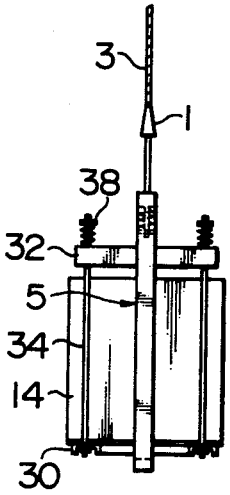
FIG. 4 is a side view of the car shown in FIG. 3.
Figure 8:
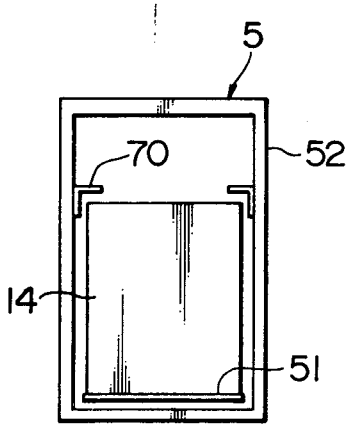
FIG. 8 is a schematic view showing the means for preventing the quick jumping movement of the car.

FIG. 8 shows means for preventing quick jumping movement of the car 14. In FIG. 4, the car 14 will suddenly jump upwardly relative to the framework 5 if the downward movement of the framework 5 is suddenly interrupted by an emergency stop means (not shown), so that the passengers will be attacked by an indefinite inquietude. The means shown in FIG. 8 is effective to prevent such quick jumping movement of the car 14. Such means comprises a plurality of stoppers 70 each attached to one of the slings 52 to prevent the quick jumping movement of the car 14. Such arrangement effectively prevents the car 14 from jumping quickly relative to the framework 5.

One embodiment of the invention is constructed as aforementioned. According to the invention, the car 14 is swingably hung from the framework 5 by a suspending means. By this arrangement, transversal vibration of the framework 5 caused by transversal vibration of the rope, deflection of the rails and eccentricity of the rollers is kept from being transmitted to the car, so that the passengers riding in the car feel comfortable.

Other embodiments of the invention shown in FIGS. 9 to 13 will be explained. There are provided a plurality of bolster means 100 interposed between the upper surface of the bottom of the framework 5 and the underside of the floor 51 of the car 14 for movement in any direction in a horizontal plane. Each bolster means 100 comprises a plurality of balls 106, an upper ball seat 102 and a lower ball seat 104, which seats both receive said balls in cooperation with one another. In this case, it is necessary to mount between the framework 5 and the car 14 a plurality of stabilizing stoppers similar to the stabilizing stoppers 40 shown in FIG. 5, to attach stoppers 112 to sling 52 of the framework 5, or to form in the floor 51 a plurality of cutouts similar to the cutouts 53 shown in FIG. 6, in order to prevent the car 14 from swinging sideways a large distance. Resilient members 108 may be interposed between the upper ball seats 102 and the underside of the floor 51 of the car 14 while other resilient members 110 may be interposed between the lower ball seats 104 and the upper surface of the bottom of the framework 5, so as to prevent the production of noise and vibration of the balls 106 and vertical movements of the framework 5 that make the passengers feel uncomfortable. The resilient members 108 and 110 may be of rubber or like substance.

The detailed construction of the bolster means 100 is shown partly in section in FIGS. 10 and 11 in which the balls 106 are held in position by a retainer 118 and a cover 120 is attached to the lower ball seat 104 to keep dust from getting into the interior of the bolster means 100.

In order to put vertical movement of the car under control, a stopper bolt 114 may be secured at its upper end to the underside of the floor 51 of the car 14, such stopper bolt 114 having its lower end portion loosely inserted in a hole 116 formed in the bottom of the framework 5. The stopper bolt 114 is mounted such that a head 115 thereof at its lower end is spaced from the underside of the floor of the framework 5 by a gap *g*. Alternatively, the pair of stoppers 70 shown in FIG. 8 may be mounted on the slings 52.

FIG. 12 shows an embodiment wherein a bolster means and a vibration preventing and load detecting anti-friction rubber member are mounted as a unit. As shown, the bolster means 100 is interposed between a second seat 122 and a first seat 124, the second seat 122 being secured to the underside of the floor of the car 14 by bolts 138 and the first seat 124 being secured by bolts 139 to the upper cover plate of a rubber member 126 for measuring the load carried by the car 14 and preventing vertical movements of the car 14 which make the passengers feel uncomfortable. The lower cover plate of the rubber member 126 is secured by bolts 140 to the bottom of the framework 5.

In this arrangement, a plurality of stopper bolts 130 for putting the horizontal and vertical movement of the car 14 under control are fixed to the second seat 122 while each of the bolts 130 is loosely inserted in one of a plurality of openings 128 formed in the first seat 124 and maintained in contact with the first seat 124 through a rubber ring 132 mounted on the bolt 130 for damping horizontal movement. Each stopper bolt 130 has a smaller head 134 and a larger head 136 at its lower end, such head 134 being smaller in its outer diameter than the inner diameter of the opening 128 and disposed in the opening 128 so as to be brought into engagement with the edge of the opening 128 when the car vibrates or moves horizontally a large amount and said larger head 136 being larger in its diameter than the inner diameter of the opening 128 and spaced apart from the first seat 124 by a gap *g* so as to absorb usual vertical movements of the car 14.

The aforementioned construction offers advantages in that the bolster means 100 and the vibration preventing and load detecting anti-friction rubber member 126 arranged as a unit can be readily removed from the car 14 and the framework 5 by loosening the bolts 138 and 140, and maintenance of both the bolster means 100 and the vibration preventing stopper mechanism can be effected readily.

The load detecting and vertical movement preventing rubber member 126 may be mounted between the underside of the floor of the car 14 and the second seat 122 as shown in FIG. 13. If this is the case, the positions of the first seat 124 and the second seat 122 are reversed.

When the car of an elevator is capable of moving freely in the horizontal direction as is the case with the present invention, there is a possibility of the car unnecessarily swinging transversely when the passengers get into or out of the car while the car is stationary. In order to prevent this phenomenon, means may be provided for locking the car in position relative to the framework to prevent horizontal movement of the former. FIG. 14 shows one form of car locking means to attain the aforementioned end. As shown, an electromagnet 142 is mounted on the bottom of the framework 5 and includes a coil 144 which is excited when the car 14 is at a standstill so as to attract to the electromagnet 142 a seat 148 for a rubber member 146 attached to the underside of the floor of the car 14, thereby preventing horizontal movement of the car 14 when it is stationary.

While the invention has been shown and described with reference to particular embodiments thereof, it will be understood, of course, that the invention is not limited thereto, since many modifications may be made, and it is contemplated therefore, by the appended claims, to cover any such modifications as fall within the scope of this invention.

We claim:

1. An elevator device for an elevator of the type comprising a car for carrying passengers or freight mounted in a framework hung by a wire rope and guided by guide means in its movement along guide rails fixed to a shaft, said elevator device being characterized in that means are provided for suspending said car in said framework to be freely swingable relative to the framework in at least a horizontal direction normal to the plane in which the framework is disposed.

2. An elevator device according to claim 1, characterized in that means is provided between the car and the framework for preventing excessive movement of said car in the horizontal direction relative to the framework.

3. An elevator device according to claim 2, characterized in that said means for preventing excess movement of said car in the horizontal direction include resilient members so that the shock of the car can be restricted by means of said resilient members.

4. An elevator device according to claim 2, characterized in that the car is provided with a floor portion, and in that said suspending means are connected to said floor portion to permit the same to be freely swingable relative to the framework.

5. An elevator device according to claim 1 characterized in that stopper means are provided and disposed in the framework for preventing quick jumping movement of the car relative to the framework which might otherwise occur when a sudden change in acceleration is generated during downward movement of the framework.

6. An elevator device according to claim 5 characterized in that said stopper means are each provided with a resilient member so that the shock of the quick jumping movement of the car can be restricted by means of said resilient members.

7. An elevator device according to claim 1 characterized in that means adapted to be rendered operative when the elevator is stationary for limiting the horizontal fluctuating movement of the car is mounted between the car and the framework.

8. An elevator device for an elevator of the type comprising a car for carrying passengers or freight which car includes a floor portion and which car is mounted in a framework hung by a wire rope and guided by guide means in its movement along guide rails fixed to a shaft, said elevator device being characterized in that said car mounted in said framework is arranged to be freely oscillatable in a horizontal direction relative to the framework, and in that said floor portion of said car is oscillatably hung from said framework by suspending means of a length of over 0.5 meter.

9. An elevator device according to claim 8 characterized in that a resilient member is mounted in a connecting portion of said suspending means for swingably hanging the car.

10. An elevator device according to claim 9 characterized in that said resilient member mounted in said connecting portion of said suspending means is a spring, and the load carried by the car is measured by utilizing the deflection of said spring.

11. An elevator device for an elevator of the type comprising a car for carrying passengers or freight mounted in a framework hung by a wire rope and guided by guide means in its movement along guide rails fixed to a shaft, said elevator device bein characterized in that said car mounted in said framework is arranged to be freely oscillatable in a horizontal direction relative to the framework, and in that a plurality of bolster means are interposed between the upper surface of the bottom of the framework and the underside of the floor of the car, each bolster means including a plurality of balls interposed between an upper ball seat and a lower ball seat, and at least a resilient member being provided between the upper ball seat and the underside of the floor of the car or between the lower ball seat and the upper surface of the bottom of the framework.

12. An elevator device for an elevator of the type comprising a car for carrying passengers or freight mounted in a framework hung by a wire rope guided by guide means in its movement along guide rails fixed to a shaft, said elevator device being characterized in that said car mounted in said framework is arranged to be freely oscillatable in a horizontal direction to the framework, and in that a bolster means including balls is held between a first seat and a second seat, said first seat supporting said bolster means on its upper surface and being mounted on the upper surface of the bottom of the framework through a resilient member interposed therebetween, said second seat being in contact at its underside with said bolster means and at its upper surface with the underside of the floor of the car.

13. An elevator device according to claim 12 characterized in that means is provided in said first seat and said second seat for restricting swinging or jumping movement of the car.

14. An elevator device according to claim 12 characterized in that a plurality of bolts are fixed to said second seat and each loosely received in an opening formed in said first seat, and a resilient member is mounted on each said bolt and disposed in each said opening so that each said bolt is brought into contact with the edge of each said opening through said resilient member.

15. An elevator device according to claim 14 characterized in that each said bolt is provided with a head adapted to be brought into engagement with the edge of each said opening when each said resilient member is flexed more than is necessary, so as to thereby prevent further deflection of the resilient member.

16. An elevator device according to claim 14 characterized in that each said bolt extends downwardly through each said opening and is formed with a head larger in outer diameter than the inner diameter of the opening in a portion thereof which extends downwardly through the opening, so that jumping movement of the car can be prevented by the engagement of said heads of said bolts with the edges of said openings.

17. An elevator device for an elevator of the type comprising a car for carrying passengers or freight mounted in a framework hung by a wire rope and guided by guide means in its movement along guide rails fixed to a shaft, said elevator device being characterized in that means are provided for suspending said car in said framework to be freely swingable relative to the framework in at least a horizontal direction normal to the plane in which the framework is disposed, means adapted to be rendered operative when the elevator is stationary for limiting the horizontal fluctuating movement of the car is mounted between the car and the framework, said means for limiting horizontal fluctuating movement when the elevator is stationary includes electromagnetic means.

18. An elevator device for an elevator of the type comprising a car for carrying passengers or freight mounted in a framework hung by a wire rope and guided by guide means in its movement along guide rails fixed to a shaft, said elevator device being characterized in that means are provided for suspending said car in said framework to be freely swingable relative to the framework in at least a horizontal direction normal to the plane in which the framework is disposed, and in that means adapted to be rendered operative when the elevator is stationary for limiting the horizontal swinging movement of the car is mounted between the car and the framework, said means for limiting horizontal swinging includes electromagnetic means, said electromagnetic means includes an electromagnet mounted on one of the framework or the car, and a plate means mounted on the other of the framework or the car, said electromagnet upon actuation attracting said plate means to limit the horizontal movement of the car.

19. An elevator device for an elevator of the type comprising a car for carrying passengers or freight mounted in a framework hung by a wire rope and guided by guide means in its movement along guide rails fixed to a shaft, said elevator device being characterized in that means are provided for suspending said car in said framework to permit the car to move freely in a horizontal direction relative to the framework, and in that means for restricting excessive movement of said car in the horizontal direction relative to the framework is provided, and stopper means are provided and disposed at the framework for restricting jumping movement of the car relative to the framework which might otherwise occur when a sudden change in acceleration is generated during downward movement of the framework.

20. An elevator device for an elevator of the type comprising a car for carrying passengers or freight mounted in a framework hung by a wire or rope and guided by guide means in its movement along guide rails, said elevator device being characterized in that means are provided for suspending said car in said framework to be freely swingable relative to the framework in at least a horizontal direction normal to the plane in which the framework is disposed, and in that means adapted to be rendered operative when the elevator is stationary are provided for limiting the horizontal fluctuating movement of the car, said limiting means being mounted between the car and the framework, said limiting means including an electromagnet mounted on one of the framework or the car, and a means mounted on the other of the framework or the car which is attracted to said electromagnet upon the actuation thereof to limit the fluctuating movement of the car.

21. An elevator device for an elevator of the type comprising a car for carrying passengers or freight mounted in a framework hung by a wire rope and guided by guide means in its movement along guide rails fixed to a shaft, said elevator device being characterized in that means are provided for suspending said car in said framework to permit the car to move freely in a horizontal direction relative to the framework, and in that means for restricting excessive movement of said car in the horizontal direction relative to the framework is provided, and stopper means are provided for restricting jumping movement of the car relative to the framework which might otherwise occur when a sudden change in acceleration is generated during downward movement of the framework.

22. An elevator device according to claim 21, characterized in that means adapted to be rendered operative only when the elevator is stationary for limiting the horizontal movement of the car is mounted between the car and the framework.

23. An elevator device according to claim 22, wherein said means for limiting the horizontal movement when the elevator is stationary includes electromagnetic means.

24. An elevator device according to claim 21, characterized in that said stopper means are provided with a resilient member so that shock of the quick jumping movement of the car can be restricted by means of said resilient members.

* * * * *